US005919074A

United States Patent [19]

Honda

[11] Patent Number: 5,919,074

[45] Date of Patent: Jul. 6, 1999

[54] DOLL DISPLAY PACKAGE FACILITATING DOLL ACTION DEMONSTRATION

[75] Inventor: Dale Honda, Cypress, Calif.

[73] Assignee: Mattel, Inc., El Segundo, Calif.

[21] Appl. No.: 09/020,264

[22] Filed: Feb. 6, 1998

[51] Int. Cl.[6] ..... A63H 3/00; A63H 33/00; B65D 25/54

[52] U.S. Cl. ..... 446/268; 446/487; 206/779

[58] Field of Search ..... 446/268, 71, 75, 446/308, 309, 310, 311, 476, 478, 487, 488; 206/736, 775, 779

[56] References Cited

U.S. PATENT DOCUMENTS

| | | | |
|---|---|---|---|
| 2,454,095 | 11/1948 | Sandlovich | 446/268 X |
| 3,378,137 | 4/1968 | Stone | 206/779 X |
| 3,406,816 | 10/1968 | Green et al. . | |
| 3,516,632 | 6/1970 | Hall | 446/268 X |
| 3,576,085 | 4/1971 | Nelson . | |
| 3,651,598 | 3/1972 | Lang | 446/268 |
| 4,234,079 | 11/1980 | Otake . | |
| 4,571,207 | 2/1986 | Henderson et al. | 446/268 X |
| 4,595,097 | 6/1986 | Herstein | 206/779 X |
| 4,925,025 | 5/1990 | Anten et al. . | |
| 5,029,702 | 7/1991 | Tong | 206/775 X |
| 5,104,124 | 4/1992 | Bernard et al. | 446/487 X |
| 5,172,806 | 12/1992 | Mickelberg . | |
| 5,289,916 | 3/1994 | Mickelberg . | |
| 5,348,145 | 9/1994 | Steinfels, III | 206/779 X |
| 5,411,138 | 5/1995 | Klawiter . | |
| 5,549,499 | 8/1996 | Foskey et al. | 446/268 |

FOREIGN PATENT DOCUMENTS

| | | | |
|---|---|---|---|
| 124098 | 3/1919 | United Kingdom | 446/268 |
| 705649 | 3/1954 | United Kingdom | 446/268 |

*Primary Examiner*—D Neal Muir
*Attorney, Agent, or Firm*—Roy A Ekstrand

[57] ABSTRACT

A display package for receiving a doll or toy figure having a bouncing action includes a vertical back, vertical sides and a vertical front forming a generally rigid enclosure. The package further includes a bottom extending between the back, sides and front of the package. A bottom liner overlying the bottom portion of the package defines an elongated slot through which a generally planar springboard member extends. A generally planar base is spaced above and generally parallel to the bottom portion and defines a large aperture exposing the springboard from above. A hinged flap is pivotally secured to the back and extends forwardly to overlie the aperture formed in the base portion. The doll or toy figure is received within the package by securing the feet of the doll or toy figure to the springboard using restraints such as ties and securing the neck portion of the doll or toy figure to the hinged flap using a flexible neck restraint. The hinged flap and springboard cooperate to restrain the doll or toy figure in a resilient support that allows the doll or toy figure to undergo its jumping action while being restrained within the package.

7 Claims, 2 Drawing Sheets

2
11
56
55
10
35
33
30
36
34
31
32
41
13
40
17
19
16
23
26
21
22
24
25
18
20
15
14
2

DOLL DISPLAY PACKAGE FACILITATING DOLL ACTION DEMONSTRATION

CROSS REFERENCE TO RELATED PATENT APPLICATIONS

This application discloses apparatus described and claimed in a related application having Ser. No. 90/020,023, filed Feb. 6, 1998, on behalf of Armen Danielian and entitled TOY HAVING JUMPING ACTION which is assigned to the assignee of the present application and is hereby incorporated herein by reference.

FIELD OF THE INVENTION

This invention relates generally to doll and similar toy product packaging and particularly to packages intended to provide a product demonstration or "try me" feature.

BACKGROUND OF THE INVENTION

The rapid and virtually unlimited development of toy products within the market place has been to some extent paced by a similar dramatic rate of development in product packaging and product packaging techniques. Thus as toy products have become increasingly entertaining, amusing, colorful and complex and sophisticated, packaging for toy products has endeavored to provide evermore interesting, amusing and attractive packaging. In addition to the basic function of toy product packaging which provides protection and convenient shipping and product handling containers for the products, toy packaging art practitioners expend great effort on making the packaging for toy products colorful, interesting, eye-catching and entertaining. One of the more significant improvements to be provided by practitioners of the toy packaging arts may be generally described as "try me" feature packaging. This type of packaging acquires its name from the capability of displaying and supporting the product in a manner which allows and encourages a potential purchaser to, in a limited sense, try the product without removing it from the package. Thus the objective of "try me" packaging is to provide an environment in which the product may be to some extent tried or demonstrated without compromising the integrity of packaging protection of the product.

For example, U.S. Pat. No. 5,172,806 issued to Mickelberg which sets forth an ANIMATED TOY IN PACKAGE and U.S. Pat. No. 5,289,916 also issued to Mickelberg and also entitled ANIMATED TOY IN PACKAGE which is a continuation-in-part of U.S. Pat. No. 5,172,806, both set forth a package for housing an animated toy having articulated moving parts. An opening in the package allows a person to operate a switch which activates the toy. When the toy is activated, moving articulated parts can be observed through openings in the package or alternatively through transparent sections in the package. In addition, lights may be activated and flashed and an enunciator may be employed to emit sounds which are seen and heard by the person while the animated toy is within the package.

U.S. Pat. No. 4,925,025 issued to Anten et al sets forth a POINT OF PURCHASE DISPLAY for a packaged toy having a temporary inexpensive battery power supply replaceable by conventional batteries for long term use. The point of purchase display permits activation of the toy while remaining in the package. Two circuits may be wired in parallel so that the battery powered toy may be operated from the battery power supply or may be disconnected therefrom when a permanent supply is placed in the toy.

U.S. Pat. No. 5,411,138 issued to Klawiter sets forth a PACKAGING FOR TOY which provides a package container having two or more transparent windowed sides in a generally rectangular box configuration. Within the box, a toy product such as a toy vehicle is secured by a folded flap formed in the bottom side of the package.

U.S. Pat. No. 3,576,085 issued to Nelson sets forth a PACKAGE TOY which provides a toy holding package functional also as a play thing comprising a structure with a central depression for holding the toy set and surrounding walls such that the appearance of human or animal bodies are provided.

U.S. Pat. No. 3,406,816 issued to Green et al sets forth a DISPLAY CONTAINER having a generally rectangular pedestal base within which a toy such as a doll is supported. A four-sided enclosure is fitted upon the base and includes three transparent sides and one opaque side. An opaque cap is fitted to the top of the four-sided enclosure.

U.S. Pat. No. 4,234,079 issued to Otake sets forth PACKAGING FOR TOY ARTICLES AND THE LIKE having a package designed for containing and exhibiting toy articles which includes a packing member having an enclosure wherein the toy articles are contained. A portion of the packing member is transparent to allow the toy articles to be viewed. A display member having a plurality of illustrations or pictures depicting the toy articles is operatively attached to the packaging member.

While the foregoing described toy product packaging devices have to some extent improved the toy packaging art, and in some instances enjoyed commercial success, there remains nonetheless a continuing need in the art for evermore improved, interesting and entertaining toy packaging.

SUMMARY OF THE INVENTION

Accordingly, it is a general object of the present invention to provide an improved display package for a doll or similar product. It is a more particular object of the present invention to provide an improved display package for a doll or similar product which facilitates demonstration of the doll or similar toy product action feature.

In accordance with the present invention, there is provided a doll having a jumping action, a doll display package comprising: an enclosure having a rear portion, a front portion, a pair of side portions extending therebetween, the front portion and the side portions being shorter than the rear portion, and a bottom portion, a springboard hingedly secured to the bottom and extending forwardly and upwardly from the bottom, a hinged flap hingedly secured to the back portion above the springboard, a neck restraint secured to the hinged flap for encircling and restraining a doll neck, and a pair of foot restraints secured to the springboard for encircling and restraining the feet of a doll against the springboard, the springboard and the hinged flap undergoing pivotal motion in response to jumping action of a doll secured to the springboard at its feet and to the hinged flap at its neck.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, and in which:

DESCRIPTION OF THE PREFERRED EMBODIMENT

Figure 1:
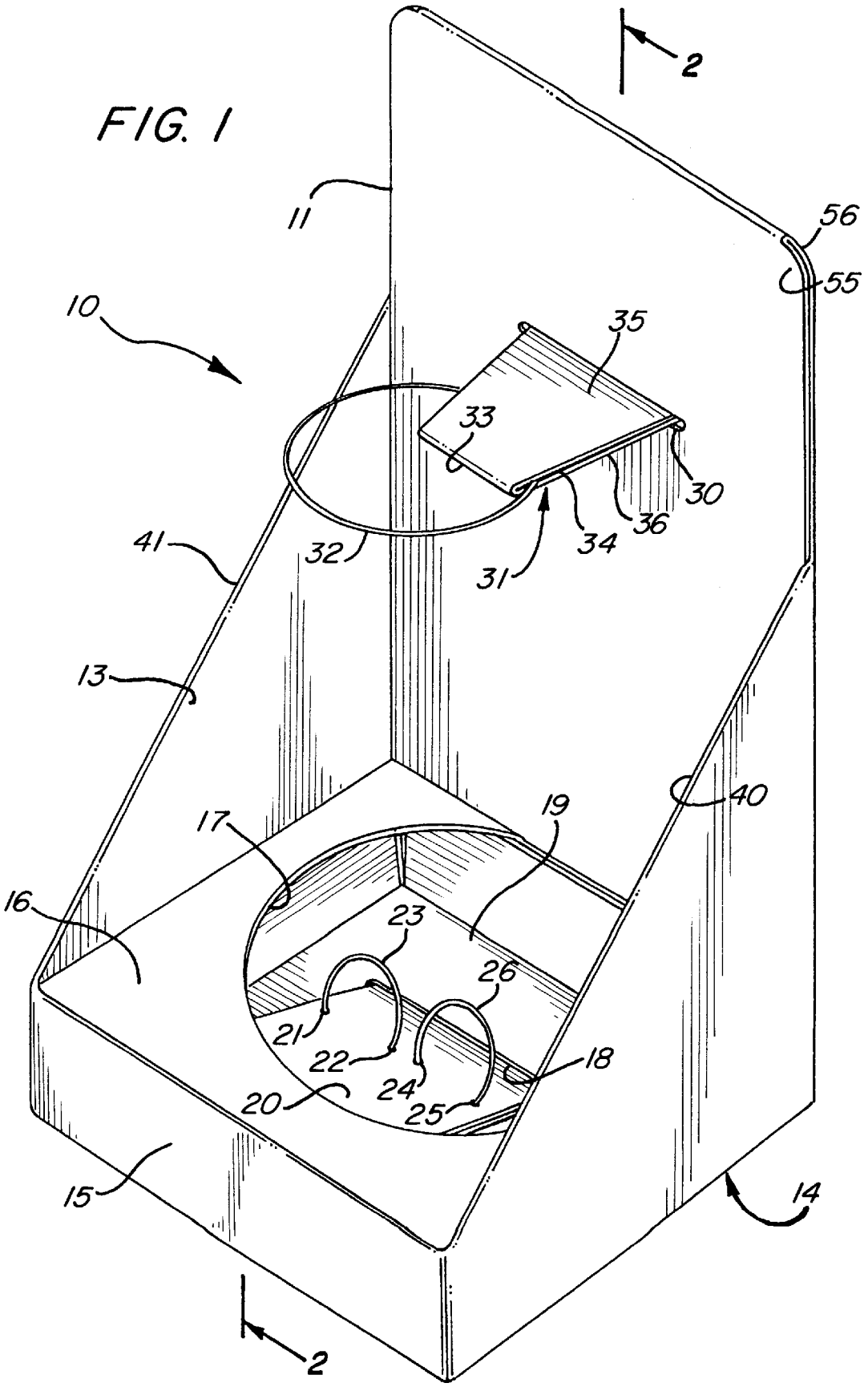
FIG. 1 sets forth a perspective view of a doll display package constructed in accordance with the present invention.

FIG. 1 sets forth a perspective view of a display package constructed in accordance with the present invention and generally referenced by numeral 10. While different materials may be used in fabricating display package 10, in the preferred fabrication thereof a suitable rigid cardboard or flake board material is used. However, it may be desirable in certain packaging environments to employ other planar sheet material such as plastic or composite material as needed. The essential characteristic of the material used to fabricate display package 10 is the ability of the material to provide relatively rigid planar elements which may be formed into the package as shown. Accordingly, display package 10 includes a generally vertical back 11 extending upwardly from a planar bottom 14. A pair of side surfaces 12 and 13 define respective angled edges 40 and 41. Sides 12 and 13 are further joined to a front portion 15. The combination of back 11, bottom 14, sides 12 and 13 together with front 15 forms a completed rigid free-standing structure having sufficient strength to perform the package containment shown in FIG. 2. In further accordance with the present invention, display package 10 further includes a generally planar base 16 extending rearwardly from front 15 to meet back 11. Base 16 defines a large aperture 17 and, in its preferred form, is generally parallelled to bottom 14 as is better seen in FIG. 2.

In further accordance with the present invention, display package 10 includes a bottom liner 19 overlying bottom 14 and defining an elongated slot 18. In the manner described below in FIG. 2 in greater detail, a springboard 20 comprising a generally planar member extending through slot 18 and disposed upwardly inclined base 16 is hingedly supported between bottom 14 and bottom liner 19. Springboard 20 defines a pair of apertures 21 and 22 through which a foot restraint 23 extends. A second pair of apertures 24 and 25 are also formed in springboard 20 and receive and support a second foot restraint 26.

In further accordance with the present invention, back 11 is formed of a pair of overlying layers 55 and 56. An elongated slot 30 is formed in layer 55 and receives a hinged flap 31. The structure of hinged flap 31 is set forth below in FIG. 2 in greater detail. However, suffice it to note here that hinged flap 31 includes an upper layer 35 and a lower layer 36 extending through slot 30 and joined at a fold 33. A space 34 exists between layers 35 and 36 and a neck restraint 32 extends therethrough.

Neck restraint 32 and foot restraints 23 and 26 may be formed of a variety of elongated restraint materials such as plastic coated wires or ties, elastic loops or tied elastic lengths, or elongated portions of material such as cord or string as desired. The essential function of restraints 23, 26 and 32 is the provision of a suitable encircling material which secures the proximate portion of the toy doll to the springboard or hinged flap as shown in FIG. 2.

Figure 2:
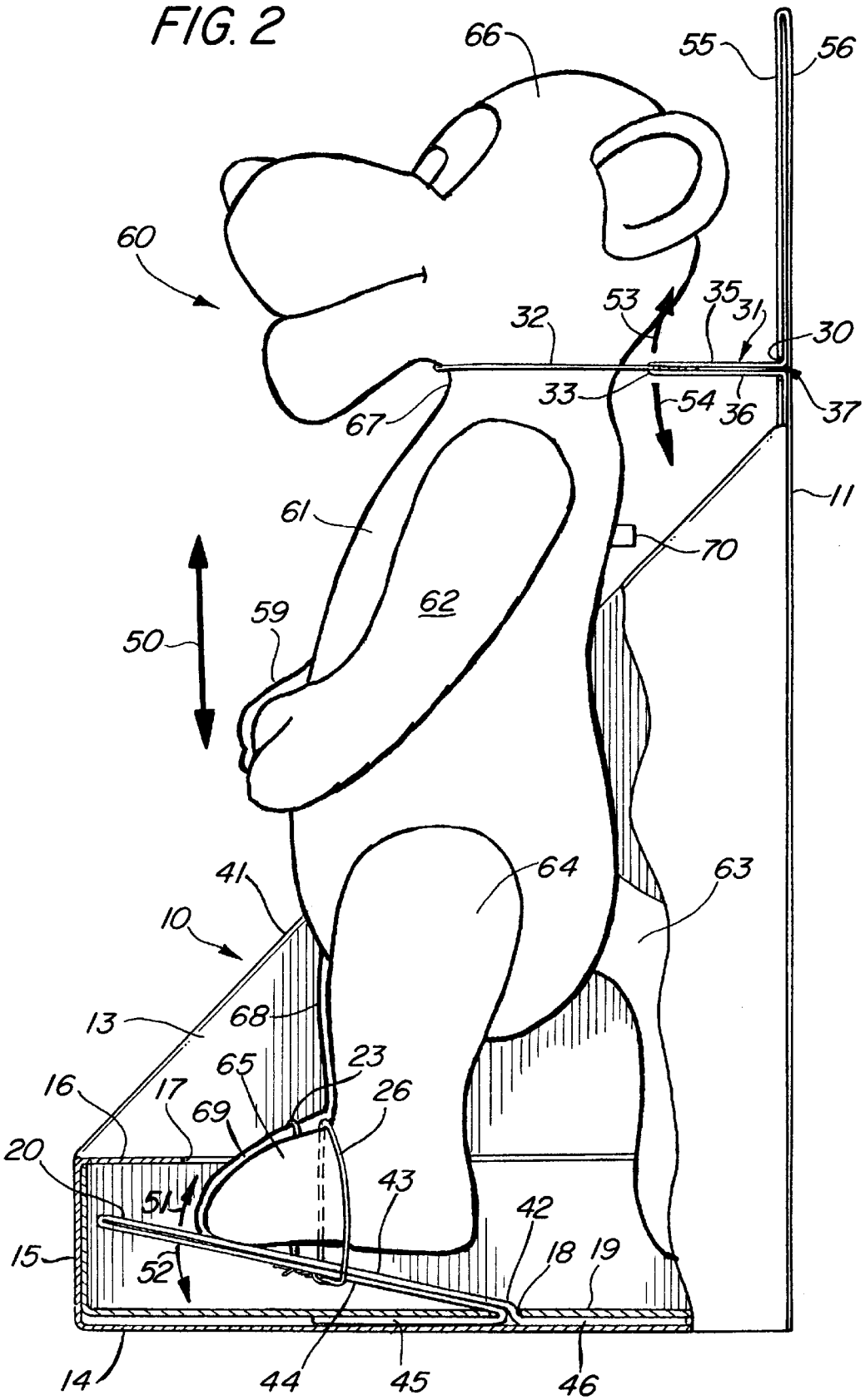
FIG. 2 sets forth a section view of the doll display package of FIG. 1 taken along section lines 2—2 therein having an exemplary doll supported therein.

In operation, display package 10 receives a doll in the manner set forth in FIG. 2 such that the doll's feet are secured to springboard 20 by foot restraints 23 and 26 allowing the doll to extend vertically therefrom. Further, display package 10 secures the doll by encircling the doll's neck in the manner shown in FIG. 2 using neck restraint 32. As mentioned, the preferred fabrication of neck restraint 32 and foot restraints 23 and 26 is provided by flexible wire ties which comprise metal wire lengths enclosed or coded with a suitable flexible plastic material. The resulting tie has been found convenient for packaging allowing the easy tying to the restraints to snugly restrain the doll within package 10. It will be apparent to those skilled in the art that other types of dolls beyond the animal character shown in FIG. 2 may be utilized without departing from the spirit and scope of the present invention. Thus, for example, a human-like doll or action figure may be received within display package 10 and restrained using neck restraint 32 and foot restraints 23 and 26. Of particular advantage and objective in display package 10 is the provision of a package container in which the resilient action of springboard 20 and the pivotal action of hinged flap 31 described below cooperate to facilitate demonstration of a doll or toy figure undergoing a vertical jumping movement or sequence of movements.

FIG. 2 sets forth a section view of display package 10 taken along section lines 2—2 in FIG. 1. For purposes of illustration, FIG. 2 further shows a toy figure generally referenced by numeral 60 secured within display package 10 in the anticipated manner of containment. As mentioned above, various figures may be secured within display package 10 and benefit from its novel aspects. However, it has been found particularly advantageous to utilize a doll having a bouncing or jumping action such as the doll set forth in the above-described related patent application which is hereby incorporated by reference. Thus for purposes of illustration, toy FIG. 60 provides a doll having a general and fanciful appearance of an animal such as a tiger. Toy FIG. 60 thus includes a torso 61 supporting a pair of arms 59 and 62 and a pair of legs 64 and 68. Legs 64 and 68 of toy FIG. 60 terminate in feet 65 and 69, respectively. A tail 63 extends rearwardly and downwardly from torso 61. A head 66 is joined to torso 61 by a neck portion 67.

In accordance with the present invention, display package 10 receives toy FIG. 60 and includes a back 11 formed by overlapping layers 55 and 56, a bottom 14 having an overlying bottom liner 19 and a front 15. Package 10 further includes sides 12 and 13 (side 12 seen in FIG. 1). As described above, display package 10 further includes a base 16 defining an aperture 17 extending between back 11 and front 15. A springboard 20 formed of a rigid cardboard or flake board material similar to that utilized in forming the remainder of display package 10 includes an upper layer 43 and a lower layer 44 folded to form a springboard extending through slot 18. Upper layer 43 passes through slot 18 and forms a flap 46 which is secured to bottom 14 and bottom liner 19 using adhesive attachment or the like. Similarly, layer 44 passes through slot 18 and forms a forwardly extending flap 45 also captivated between bottom 14 and bottom liner 19. Flap 45 may also be attached using conventional adhesive attachment. Alternatively, flaps 45 and 46 may be sufficiently captive between bottom liner 19 and bottom 14 to avoid the need for adhesive attachment. Upper layer 43 and lower layer 44 are folded through slot 19 to form a hinge 42 about which springboard 20 is resiliently pivotable. Thus springboard 20 is able to pivot about hinge 42 as indicated by arrows 51 and 52.

Display package 10 further includes a hinged flap 31 formed of an upper layer 35 and a lower layer 36 forming a fold 33 which receives a neck restraint 32. Upper layer 35 and lower layer 36 of hinged flap 31 passed through slot 30 of layer 55 and extend between layers 55 and 56 such that the end portion of layer 35 extends upwardly between layers 55 and 56 while the end portion of layer 36 extends downwardly between layers 55 and 56. As a result, layers 35 and 36 form a folded hinge 37 within slot 30. Hinge 37 permits hinged flap 31 to pivot in the directions indicated by arrows 53 and 54.

In operation, toy FIG. 60 is secured within package 10 by placing toy FIG. 60 between sides 12 and 13 (the former seen in FIG. 1) and extending legs 64 and 68 downwardly through aperture 17 until feet 65 and 69 are received upon springboard 20. Thereafter, restraints 26 and 23 are secured to feet 65 and 69 captivating the feet of toy FIG. 60 against springboard 20. The securing of toy FIG. 60 is completed by encircling neck portion 67 thereof with neck restraint 32 such that neck 67 is secured to fold 33 of hinged flap 31. At this point, toy FIG. 60 is completely restrained within display package 10.

As set forth in the above-identified related patent application, toy FIG. 60 in its preferred form provides a bouncing or jumping action in which legs 64 and 68 are repeatedly drawn upwardly into torso 61 against a spring bias and released allowing legs 64 and 68 to spring downwardly launching toy FIG. 60 in a bouncing action. In accordance with an important aspect of the present invention, toy FIG. 60 is able to demonstrate this bouncing animation while remaining restrained within display package 10.

Thus with on/off switch 70 of toy FIG. 60 accessible to the user when toy FIG. 60 is restrained within package 10, the user is able to reach on/off switch 70 and turn toy FIG. 60 on causing it to undergo its jumping action. During this jumping action, the movement of legs 64 and 68 upwardly with respect to torso 61 and the rapid downward thrusting which provides the bouncing action of toy figure 60 is accommodated by the pivotal resilient motions of springboard 20 and hinged flap 31. Thus as toy FIG. 60 is repeatedly moved in the vertical directions indicated by arrows 50, springboard 20 is pivoted in the directions indicated by arrows 51 and 52 and hinged flap 31 is pivoted in the directions indicated by arrows 53 and 54. As a result, the bouncing and jumping action of toy FIG. 60 is observable while the toy figure remains restrained within package 10. At any time the user may terminate the demonstration of toy FIG. 60 by simply reaching switch 70 and moving it to the off position. The resilience of springboard 20 and hinged flap 31 about their respective hinges 42 and 37 tends to return toy FIG. 60 to the position shown in FIG. 2 when toy FIG. 60 is inoperative.

What has been shown is a doll display package which facilitates the demonstration of a doll action having a jumping or bouncing activity while maintaining the doll within the package integrity. The display package shown is readily fabricated of conventional paper board, cardboard or flake board or similar conventional packaging materials.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in containing and displaying a doll having a jumping action, a doll display package comprising:

an enclosure having a rear portion, a front portion, a pair of side portions extending therebetween, said front portion and said side portions being shorter than said rear portion, and a bottom portion;

a springboard hingedly secured to said bottom and extending forwardly and upwardly from said bottom;

a hinged flap hingedly secured to said back portion above said springboard;

a neck restraint secured to said hinged flap for encircling and restraining a doll neck; and a pair of foot restraints secured to said springboard for encircling and restraining the feet of a doll against said springboard, said springboard and said hinged flap undergoing pivotal motion in response to jumping action of a doll secured to said springboard at its feet and to said hinged flap at its neck.

2. The doll display package set forth in claim 1 wherein said bottom portion, a generally planar bottom and an overlying bottom liner having a slot therein and wherein said springboard extends through said slot.

3. The doll display package set forth in claim 2 wherein said springboard includes:

an upper layer and a lower layer joined at a fold;

a first flap extending from said upper layer through said slot between said generally planar bottom and said bottom liner; and a second flap extending from said lower layer through said slot between said generally planar bottom and said bottom liner.

4. The doll display package set forth in claim 3 further including a generally planar base extending between said sides and said front and back portions above said bottom liner defining an aperture exposing a portion of said springboard.

5. The doll display package set forth in claim 4 wherein said springboard upper and lower layers each define a plurality of apertures and wherein said pair of foot restraints includes first and second flexible elongated ties passing through selected apertures in said upper and lower layers to form foot-encircling loops.

6. The doll display package set forth in claim 5 wherein neck restraint includes a third flexible elongated tie formed into a neck-encircling loop joined to said hinged flap.

7. The doll display package set forth in claim 6 wherein said sides are angled downwardly from said rear portion toward said front portion.

* * * * *